United States Patent [19]

DeRyke et al.

[11] 4,007,925

[45] Feb. 15, 1977

[54] VERTICAL RISE SHEET FEEDER

[75] Inventors: Thomas Vernon DeRyke, Libertyville; Willard James Holman, Barrington, both of Ill.

[73] Assignee: Addressograph Multigraph Corporation, Cleveland, Ohio

[22] Filed: Oct. 24, 1975

[21] Appl. No.: 625,595

[52] U.S. Cl. ..... 271/160; 271/126; 271/171; 214/8.5 A

[51] Int. Cl.[2] ..... B65H 1/08

[58] Field of Search ..... 271/22, 24, 30 R, 126–128, 271/147, 160, 170, 171, 219, 223; 312/71, 306; 211/49 D; 214/8.5 A; 221/59, 60, 232, 279

[56] References Cited

UNITED STATES PATENTS

| | | | |
|---|---|---|---|
| 1,130,109 | 3/1915 | Rolier | 271/160 |
| 1,307,261 | 6/1919 | Lee | 312/306 |
| 1,811,428 | 6/1931 | Dibble | 312/306 UX |
| 2,850,203 | 9/1958 | Eurey | 312/71 |
| 3,285,601 | 11/1966 | Zeuthen | 271/22 |
| 3,406,964 | 10/1968 | Eichorn | 271/171 |
| 3,843,115 | 10/1974 | Di Fulv io et al. | 214/8.5 A |

FOREIGN PATENTS OR APPLICATIONS

| | | | |
|---|---|---|---|
| 1,073,763 | 9/1954 | France | 271/28 |

*Primary Examiner*—Robert W. Saifer
*Attorney, Agent, or Firm*—Sol L. Goldstein; Michael A. Kondzella

[57] ABSTRACT

A vertical rise sheet feeder is provided comprising means responsive to the weight of a stack of sheets for positioning and maintaining the stack at a feed level for the feeding of a single sheet at a time from the top of the stack. The sheet feeder includes a fixed platform and a vertically movable platform for supporting the stack. The movable platform is powered by a stabilizer means and its movement is regulated by linkage means interconnected by a torsion bar. The torsion bar controls operation of the linkage means in unison and provides a degree of freedom to the movable platform for maintaining the top of the stack in an aligned position such that a feed roller means exerts uniform and equal forces on the sheets to provide for accurate and positive feeding of the sheets from the stack. The feeder also includes a sheet locating and guiding means for maintaining the stack of sheets centered on the movable platform and for guiding the sheets as they are fed from the stack.

12 Claims, 8 Drawing Figures

10
A
2
3
54
26
14
68
52
22
50
56
40
38
28
42
32
18
74
170
58
60
64
12
24

68
20a
50
10
80
14
20
22
52
20b
26
78
76
34
77
22a
22b
44
30
32
38
66
48
62
64
24
36
42
60
16
18
170
16b
58
16a
74
12
18a
18b 162
68
106
108
10
14
112
110
22
20
26
22a
20a
20b
22b
160
40
32
28
30
46
24
60
16
18
170
18a
12
16a 20
60
60
68
10
120
120
30
118
118
144
110
160
26
140
142
162
112
128
126
36
86
34
148
130
28
92
100
84
5
5
150
152
90
74
92-1
99
82
97
156
158
154
92-2
98
94
132
146
124
108
122

32
24
134
162
136
160
114
62
106
138
114
62
38
42
18a
66
66
18b
18
58
60
64
40
58
60
64
170
14
26
80
78

76
34
80
36
77
78
90
84
86
92-1
24
76
74
89
87
88
98
77
99
82
96
94
97
12

VERTICAL RISE SHEET FEEDER

BACKGROUND OF THE INVENTION

There are known devices as shown, for example, in U.S. Pat. No. 2,750,804 for controlling the lifting of a stack of sheets for maintaining the stack at a correct level for feeding a sheet at a time from the top of the stack.

As shown in the reference device, there is provided a lifting jack for raising the stack in increments in response to a sensing device set to actuate the jack when the level of the stack falls below the correct feeding level. The sensing device comprises a sensing arm in contact with the top of the stack and a stop member. When the stack is at the correct level, the stop member is in a first position to prevent operation of the jack. When the stack falls below the correct level, the stop member is displaced to a second position to permit operation of the jack to lift the stack until it is raised to the correct level, at which time the stop member is again moved to the first position. With the stack at the correct level, the sheets are fed from the top of the stack by feed rollers.

Because the device of the foregoing patent provides for lifting the stack incrementally in a step-by-step manner, resulting in the top of the stack being positioned between a position in contact with the feed rollers and varying positions spaced from the feed rollers, the feed rollers do not always exert equal and uniform forces against the top sheet being fed. Thus, and particularly when the top of the stack is out of contact with the feed rollers, the sheet feeding operation could result in skewed feeding of the sheets, mis-register, doublefeeds, skip feeds and the like. Also, the apparatus comprises a substantial number of component parts which not only add to the cost of the device but likely also necessitate frequent adjustment, servicing and maintenance.

SUMMARY OF THE INVENTION

The present invention provides a vertical rise sheet feeder in which the stack height is controlled in response to the weight of the stack such that the top of the stack is maintained at a feed level in contact with the feed roller means at all times. In this way the feed roller means exerts uniform force to the stack for accurate and positive feeding of a sheet in each cycle of operation.

As sheets are fed from the stack resulting in a change in paper weight, the rate of change of the force applied to the movable platform supporting the stack by the stabilizer or spring means equals the rate of change of paper weight. Therefore, the force or pressure applied to the sheet surface by the feed roller means is the same throughout the entire paper feeding process.

An object of the invention is to provide an improved stack raising apparatus for maintaining the stack at the correct level for feeding one sheet at a time from the top of the stack in each cycle of operation.

Another object is to provide a spring means associated with a linkage means and a torsion bar for maintaining the top of the stack in an aligned position with the feed roller means so that the feed roller means exerts substantially equal forces to the sheet being fed for positive and accurate feeding of the sheet from the stack.

Another object is to provide a spring means such that the rate of change of the spring force applied to the movable platform equals the rate of change of paper weight resulting in the force applied to the sheet by the feed roller means being uniform throughout the entire feeding process.

A further object is to provide a stack locating and sheet guiding means for maintaining the stack centered on the movable platform and for guiding the sheets in register as they are advanced from the stack.

A feature of the invention is to provide a vertical rise sheet feeder which is compact, reliable in use and may be installed on existing machines without requiring major modification to the machines.

The foregoing objects are attained by providing a fixed platform and a vertically movable platform for supporting a stack of sheets in which the sheets are fed singly from the top of the stack by feed roller means. The movable platform is operated or powered by a spring means and is regulated in its movement by two four-bar linkage means which are tied together by a torsion bar. The torsion bar controls operation of the two linkage means in unison and also provides a degree of freedom to the movable platform to assure that the stack is maintained parallel and in alignment with the feed roller means. Thus, the feed roller means exerts substantially equal forces on the stack for positive feeding of the sheets therefrom.

Other objects, features and advantages of the invention will appear hereinafter as the description proceeds.

IN THE DRAWING

DESCRIPTION OF THE PREFERRED EMBODIMENT

Figure 1:
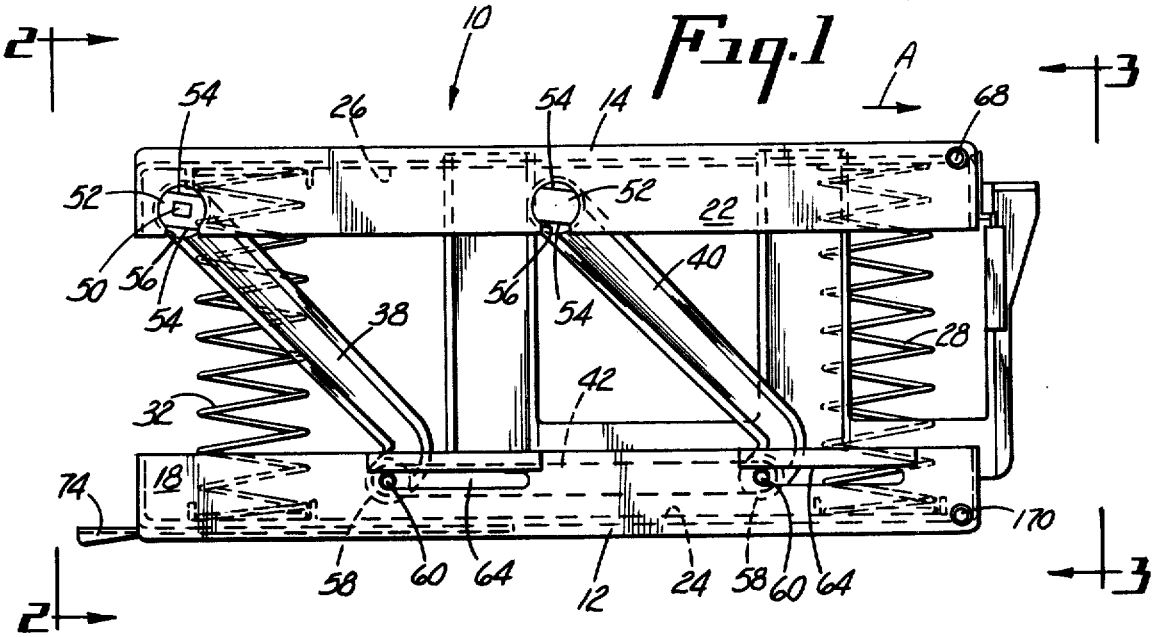
FIG. 1 is a side elevation of a vertical rise sheet feeder constructed in accordance with the present invention.
Figure 2:
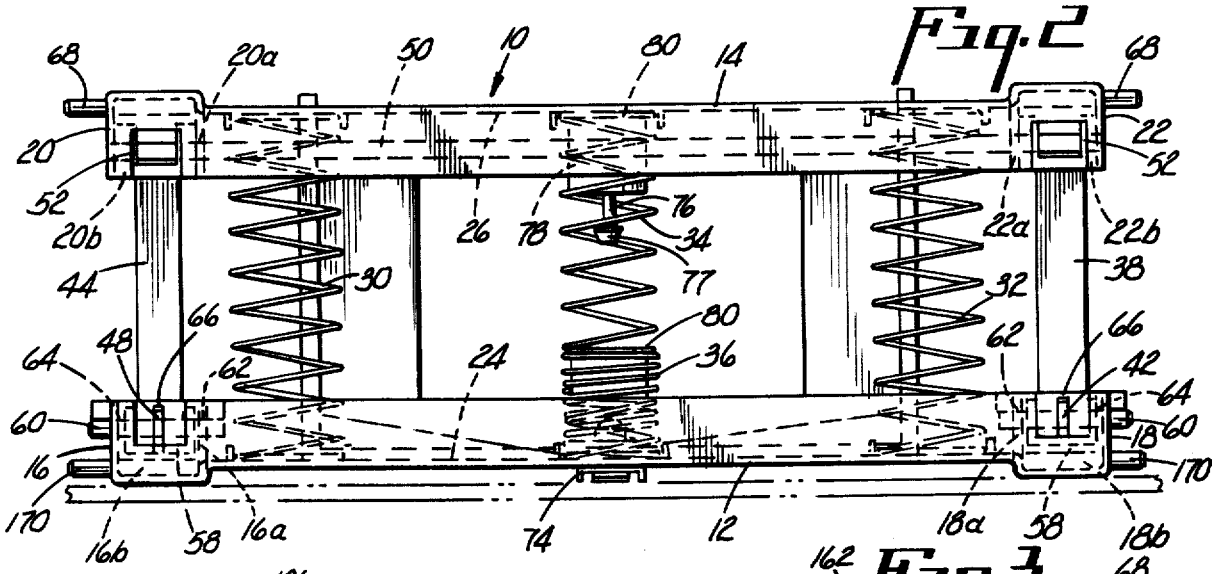
FIG. 2 is an end elevation as viewed on the line 2—2 in FIG. 1.
Figure 3:
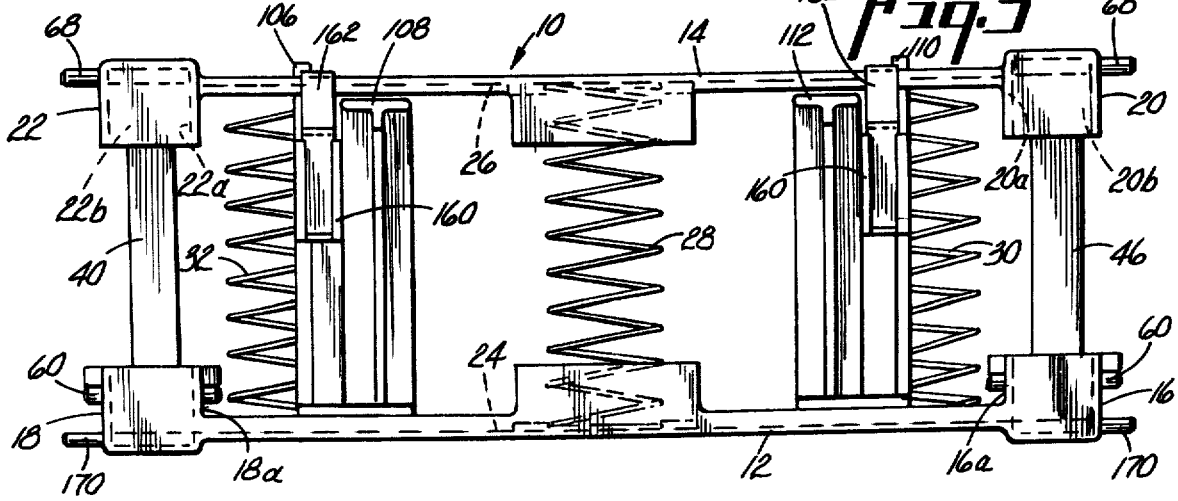
FIG. 3 is an end elevation as viewed on the line 3—3 in FIG. 1.
Figure 6:
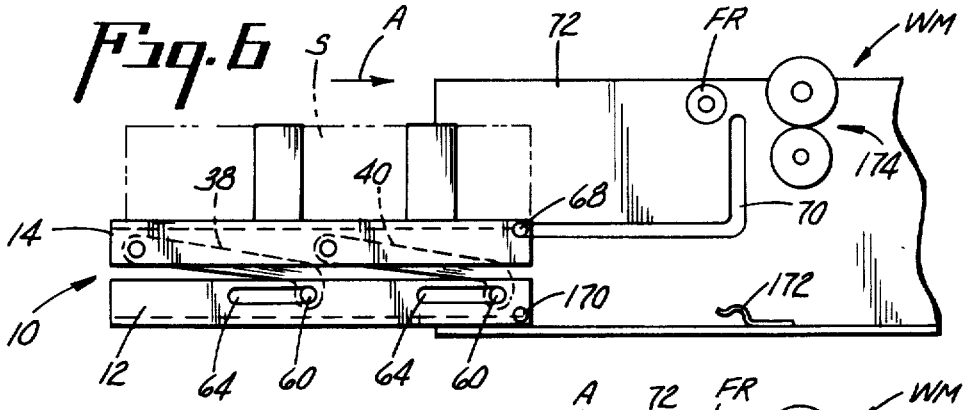
FIGS. 6 – 8 are schematic side elevations showing the mounting of the vertical rise sheet feeder on a work machine which illustrate, respectively, a stack loading position, a start to feed position and a finish feeding position of the feeder.
Figure 7:
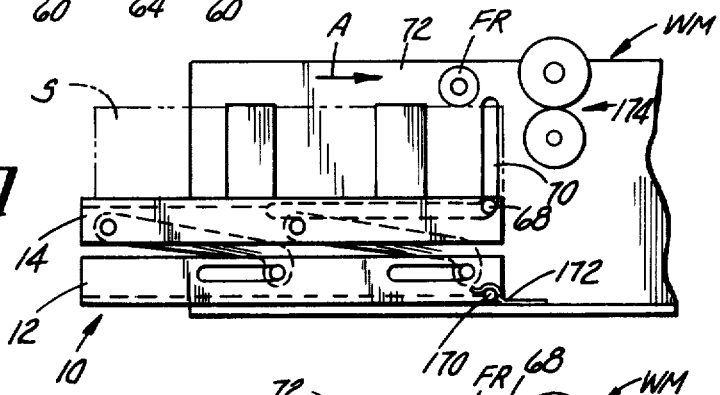

With reference to FIGS. 1 – 3, the vertical rise sheet feeder is indicated generally by the reference numeral 10 and comprises a fixed platform 12 and a movable platform 14 for supporting thereon a stack of sheets S, as shown in FIGS. 6 and 7, to be fed to a work machine WM such as, for example, a copier, duplicating machine or the like. Although for clarity the platforms 12 and 14 are not shown as being identical in the drawing, in practice the platforms are preferably identical and symmetrical and constructed of molded plastic from a common mold.

Figures 4, 5:
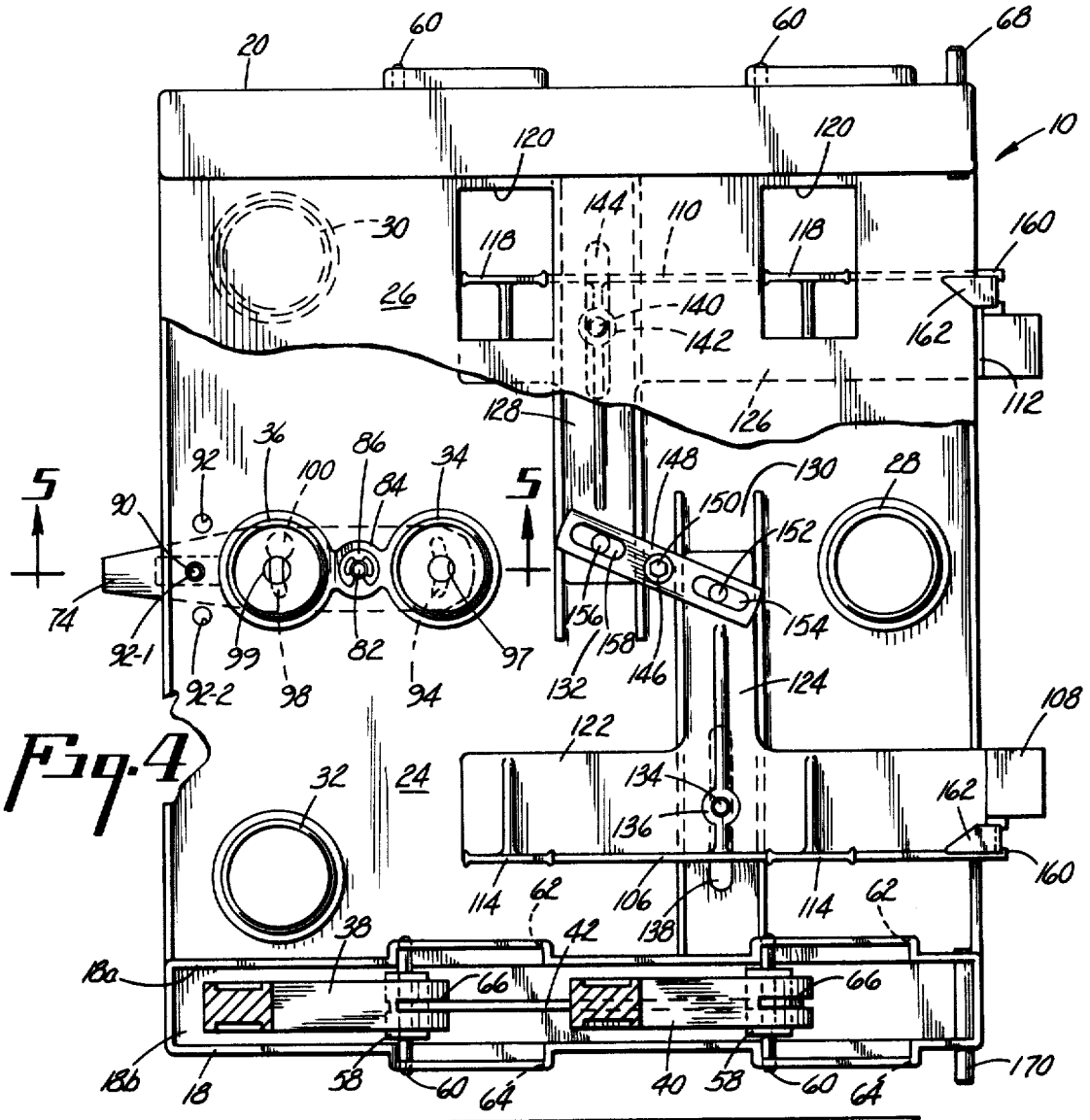
FIG. 4 is a plan view, partially broken away and partially in section, of the vertical rise sheet feeder.
FIG. 5 is a section taken along the line 5—5 in FIG. 4.

As shown in FIGS. 2, 3 and 4, the fixed platform 12 is provided at one lateral side with an outer wall 16 and an inner wall **16*a* to provide therebetween a channel 16*b* extending the length of the platform in a direction of sheet feed as indicated by arrow A in FIGS. 1, 6 and 7. A similar channel 18***b* is provided at the other side of the platform 12 between an outer wall 18 and an inner wall 18*a*. The platform 14 also comprises an outer wall 20 and an inner wall 20*a* forming therebetween a channel 20*b* extending along one lateral side of the platform, and a similar outer wall 22 and an inner wall 22*a* providing therebetween a channel 22*b* extending along the other side of the platform 14. Further, the platform 12 is provided with a surface 24 extending between the inner walls 16*a* and 18*a*, and the platform 14 is provided with a surface 26 extending between the inner walls 20*a* and 22*a*.

The movable platform 14 is powered in its vertical movement by a stabilizer means comprising a set of compression springs 28, 30 and 32 (see FIGS. 1 – 4) and a pair of selectively operable springs 34 and 36, and is regulated in its movement by a first and a second pair of four-bar linkage means. The first pair of four-bar linkage means comprises the platform 14 which serves as a base link, a first pair of control links 38 and 40, and a tie link 42 interconnecting the control links 38 and 40. The second pair of four-bar linkage means, positioned at the side of the sheet feeder 10 opposite the control links 38 and 40, is the same as the first pair of linkage means and comprises the platform 14 which provides a base link, a second pair of control links 44 and 46, (FIGS. 2 and 3) and a tie link 48 interconnecting the control links 44 and 46.

The upper ends of the control links 38 and 44 are interconnected by a torsion bar 50 (FIGS. 1 and 2) which ties together the first and the second pair of linkage means for controlling operation of both of the linkage means in unison and providing a degree of freedom to the movable platform 14 for maintaining the top of the stack S in an aligned position to permit feed roller means FR (FIGS. 6 – 8) to exert equal and uniform forces on the sheets fed from the stack. The four-bar linkage means will now be described and, because both of the first and the second pair of linkage means are the same in construction and operation, only one pair of linkage means will be described in detail hereinafter.

The control links 38 and 40 are preferably made of plastic and, as shown in FIGS. 1, 2, 3 and 4, each comprises at its upper end a bearing 52 positioned within the channel 22*b*. Each of the bearings 52 includes a pair of flats 54 at each end thereof to permit the bearing to be positioned within and retained by keyhole slots 56 provided in the outer and the inner walls 22 and 22*a* respectively. The lower ends of the control links 38 and 40 are each provided with a hub 58, positioned within the channel 18*b* of the fixed platform 12, for supporting therein a fixed guide pin 60. The guide pin 60 extends outwardly from both ends of the hub 58, with one end of the guide pin projecting into a guide slot 62 provided in the inner wall 18*a* and the other end of the guide pin projecting into a guide slot 64 provided in the outer wall 18.

The lower ends of the control links 38 and 40 are each provided with a vertical slot 66 (FIGS. 2 and 4) for receiving therein an end of the tie link 42 supported on the guide pins 60. As the movable platform 14 is moved between raised and lowered positions, the tie link 42 moves the control links 38 and 40 in unison and the guide pins 60 positioned in the slots 62 and 64 support and guide the movement of the control links in their pivotal movement about the bearings 52 supported in the keyhole slots 56.

Referring now to FIGS. 1 – 5, showing means for powering the movable platform 14 in its vertical movement, the springs 28, 30 and 32 are positioned between the surfaces 24 and 26 and apply a biasing force thereto to urge the platforms 12 and 14 apart. The spring 28, positioned on the lateral centerline of the platforms 12 and 14 and on a vertical line passing through the axis of the feed roller means FR, also loads the platform 14 in a direction opposite to the direction of sheet feed. This arrangement affords an oscillating motion to the platform 14 and prevents guide pins 68 (to be described later) from binding in control slots 70 provided in each of a pair of side plate 72 of the work machine WM, only one side plate 72 being shown in FIGS. 6, 7 and 8 of the drawing.

With a stack of sheets S positioned on the movable platform 14, and the sheet feeder 10 positioned in the start to feed position shown in FIG. 7, the stabilizer means or springs 28, 30 and 32 apply a biasing force to the platform 14 to urge it upwardly to position the top of the stack at the feed level in feeding contact with the feed roller means FR. Thus, as the stack S is diminished and the weight of the stack reduced by the feeding of sheets from the stack, the stabilizer means provides for the rate of change of the force applied by the stabilizer means to the movable platform 14 to equal the rate of change of the stack weight. In this way, the top of the stack is maintained at a uniform feed level such that the force applied to the sheet by the feed roller means, to advance the top sheet from the stack, is uniform throughout the entire feed range regardless of the size and the weight of the stack.

The sheet feeder has the capacity to handle a full ream of sheets and, because the height of the stack of sheets is controlled by the weight of the stack, the stack is maintained at the feed level no matter what the thickness of the sheets or even if the stack is a mixture of sheets of various thicknesses.

The springs 34 and 36, also positioned on the lateral centerline of the platforms 12 and 14 but adjacent the rear end of the sheet feeder 10, are adapted to be manually and selectively operable in conjunction with the springs 28, 30 and 32 to increase the amount of force exerted between the platforms 12 and 14 in accordance with heavier weights of the stack of sheets to be fed. By means of a spring selector lever 74, the springs 34 and 36 may be disengaged from the platform 14 whenever the additional force exerted by these springs against the platform 14 is not required because of the lighter weight of the stack S.

The selector lever 74 is adapted to engage a stem 76 of a plunger 78, (FIG. 5) associated with each of the springs 34 and 36, to hold the spring captive between a spring seat 80 on the plunger 78 and the surface 24 of the platform 12. Under normal operating conditions, the three springs 28, 30 and 32 only are utilized in the feeding of sheets from the stack when the weight of the stack is a light load; the three springs and the spring 34 are utilized for medium weight loads; and the three springs and the spring 36, which is made of a larger diameter wire than the wire diameter of the spring 34, are utilized for heavy weight loads.

As mentioned supra, the spring means is designed for operation such that the rate of change of the weight of the stack S equals the rate of change of the spring force applied to the movable platform 14. The force applied to the sheets by the feed roller means FR is, therefore, constant and uniform throughout the entire feed range of the platform 14.

As best shown in FIGS. 4 and 5, the selector lever 74 is provided with a pin 82 for pivotally mounting the selector lever to the underside of the surface 24 of the fixed platform 12. The pin 82 is supported in a boss 84 of the platform 12 and is held in place by a retainer 86. The selector lever 74 is also provided with a leaf spring 88 rigidly secured at 89 to the underside of the selector lever for biasing the selector lever in an upward direction towards the surface 24. A detent pin 90 is also provided on the leaf spring 88 and projects upwardly through an opening 87 in the selector lever for coaction with any one of three stop positions defined by holes 92, 92-1 and 92-2 provided in the surface 24, as shown in FIG. 4. The selector lever 74 is adapted to be pivoted in either direction about the pivot pin 82, and is retained in any one of the three stop positions by positioning the detent pin 90 into a selected hole 92, 92-1 or 92-2 under the bias of the leaf spring 88.

The selector lever 74 is also provided with an arcuate slot 94 having an enlarged hole 96 at the center thereof for receiving the stem 76 associated with the spring 34, and an arcuate slot 98 having an enlarged hole 100 (FIG. 4) at one end thereof for receiving the stem 76 associated with the spring 36. The slots 94 and 98 are positioned on an arcuate centerline scribed from the axis of the pivot pin 82 to permit clockwise and counter clockwise movement of the selector lever 74 for positioning the same at any of the three positions.

The stems 76 of each of the plungers 78 associated with the springs 34 and 36 are each provided with a head 77 which passes freely through the holes 96 and 100, and corresponding holes 97 and 99 respectively, in the surface 24 of the platform 12, but does not pass through the arucate slots 94 and 98. Thus, in the position of the selector lever 74 as shown in FIGS. 4 and 5, the holes 96 and 97 are in alignment with the stem 76 of the spring 34 thereby releasing the head 77 from holding engagement with the slot 94 and causing the spring 34 to be released and extended to exert a biasing force upwardly against the movable platform 14. However, the stem 76 of the spring 36 is positioned within the slot 98 thereby preventing passage of the head 77 of the stem therethrough and maintaining the spring 36 in a captive or compressed condition so as not to act against the platform 14. This setting of the selector lever 74 may be utilized when feeding sheets from a stack having a weight as defined above as a medium load.

As the selector lever 74 is pivoted in a counter clockwise direction as viewed in FIG. 4, to position the detent pin 90 in the hole 92-2, the holes 99 and 100 are aligned with the stem 76 of the spring 36 thereby releasing the head 77 of the stem from holding engagement with the slot 98 and causing the spring 36 to act upwardly against the movable platform 14. In this case, the stem 76 of the spring 34 is positioned within the slot 94 and prevents the head 77 of the stem from passing therethrough to maintain the spring 34 captive against movement towards the platform 14. Because, as mentioned hereinabove, the spring 36 is made of a wire guage heavier than the wire guage of the spring 34, this setting of the selector lever 74 may be utilized for the feeding of sheets from a stack having a weight as defined above as a heavy load.

In the third setting of the selector lever 74, when it is pivoted in a clockwise direction as viewed in FIG. 4 and the detent pin 90 is positioned in the hole 92, both stems 76 of the springs 34 and 36 are positioned within the slots 94 and 98 respectively, and the heads 77 of the stems are prevented from passing therethrough. Thus, both of the springs 34 and 36 are held captive so as not to act against the movable platform 14. This setting of the selector lever 74 may be utilized in the feeding of sheets from a stack having a weight as defined above as a light load, wherein only the springs 28, 30 and 32 apply an upward biasing force to the movable platform 14.

With reference to FIGS. 3 and 4, there is also provided means for locating and centering the stack S on the movable platform 14 and for guiding the sheets as they are fed from the stack to the work machine WM, comprising a right side guide 106 provided with a front stop 108 and a left side guide 110 provided with a front stop 112. The right side guide 106 is provided with a pair of vertical walls 114 each projecting upwardly through a corresponding opening (not shown) in the surface 26 of the platform 14 for coacting with one lateral side of the stack S, and the left side guide 110 is provided with a similar pair of vertical walls 118 each projecting upwardly through a corresponding opening 120 in the platform 14 for coacting with the other lateral side of the stack S. The vertical walls 114 terminate at their lower ends in a T-shaped base 122 including a runner 124 and the vertical walls 118 similarly terminate at their lower ends in a T-shaped base 126 including a runner 128. Preferably, the side guides comprising the vertical walls, bases and runners are of integral plastic molded construction.

The runner 124 is adapted for sliding movement in a track 130 provided on the surface 24 of the fixed platform 12 for positioning the side guide 106 towards or away from one side of the stack. Another track 132, spaced from and parallel with the track 130, is provided on the surface 24 for guiding the sliding movement of the runner 128 for positioning the side guide 110 towards or away from the other side of the stack. The runner 124 is retained and guided in its sliding movement in the track 130 by a shoulder screw 134 extending upwardly through a spacer 136 provided on the underside of the surface 24 and an elongate slot 138 in the surface 24, and the screw is threaded into the runner 124. Similarly, the runner 128 is retained and guided in its sliding movement in the track 132 by a shoulder screw 140 extending upwardly through a spacer 142 on the underside of the surface 24 and an elongate slot 144 in the surface 24, and the screw is threaded into the runner 128.

An upstanding boss 146 is provided on the surface 24, intermediate the tracks 130 and 132, for pivotally supporting on a member 150 a strap 148 tying together the runners 124 and 128. The runner 124 is provided with a pin 152 coacting with a slot 154 provided at one end of the strap 148, and the runner 128 is provided with a pin 156 coacting with a slot 158 at the other end of the strap 148. Hence, as one of the side guides 106 or 110 is moved towards or away from the side edge of the stack S, the pins 152 and 156 pivot the strap 148 which imparts simultaneous and equal movement to the other side guide to thereby position the vertical walls 114 and 118 against the sides of the stack S to maintain the stack centered on the platform 14.

The front or lead end of the stack S is held in alignment against the front stops 108 and 112. Also, each of the front stops may be provided with a vertical channel member 160 for receiving therein a corner separator 162 as shown in FIGS. 3 and 4. The corner separators are adapted to rest on the lead end corners of the top sheet of the stack and serve to separate the top sheet from the stack by causing the sheet to buckle and snap over the corner separators in response to the feed roller means FR applying a feed force to the sheet.

Figure 8:
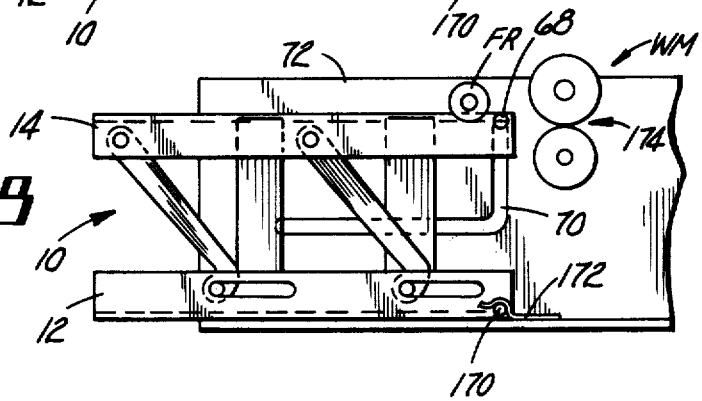

FIGS. 6 – 8 illustrate the mounting arrangement of the vertical rise sheet feeder 10 on the work machine WM. The feeder 10 is positioned between the side plates 72 with the guide pins 68 positioned in the corresponding L-shaped control slots 70 in the side plates. The stack S of sheets to be fed is placed on the movable platform 14 which is pushed downwardly defining a stack loading position, as shown in FIG. 6, and the entire feeder is then moved forwardly in a direction of sheet feed until the pins 68 are positioned at the bottom of the vertical portions of the L-shaped slots 70 defining a start to feed position, as shown in FIG. 7. At this time the spring means is effective to urge the movable platform 14 upwardly to maintain the top of the stack at the feed level in contact engagement with the feed roller means FR.

In this position, as shown in FIG. 7, the feeder 10 is retained in position by a pin 170, provided in each side of the fixed platform 12, which is engaged by a corresponding catch 172 provided on the work machine WM. Only one pin 170 and one catch 172 are shown in the drawing. As the sheets are fed from the stack S to transport means 174 of the work machine, the movable platform 14 continues to be urged upwardly to maintain the top of the stack in constant engagement with the feed roller means FR. During a feeding operation the movable platform 14 oscillates, in the plane of sheet feed, within the limits set by the pins 68 in the control slots 70. This oscillating movement breaks inherent friction in the system to insure indexing or movement of the platform 14 for each sheet fed from the stack S. Upon completion of the feeding of all of the sheets in the stack, the feeder 10 is in a finish feeding position as shown in FIG. 8. Thereafter, the movable platform 14 is depressed to position the support pins 68 at the bottom of the vertical portions of the control slots 70, and the feeder is pulled rearwardly to disengage the pins 170 from the catches 172 (FIG. 6) in readiness to receive another stack for a subsequent feeding operation.

From the foregoing, it will be appreciated that the present invention provides a vertical rise sheet feeder adapted for feeding sheets of varying thicknesses and weights from the top of the stack of sheets. The stabilizer means in association with the linkage means and the torsion bar regulate and control the lifting of the stack to maintain the stack at the correct feeding level in contact engagement with the feed roller means in response to the weight of the stack. The selectively operable springs are readily positionable into and out of operative positions and provide a simple but effective means for increasing the biasing force applied to the movable platform when feeding sheets from a stack comprising a medium or a heavy load. Further, the side guides are conveniently positionable for maintaining the stack centered on the platform and for accurately guiding the sheets as they are advanced from the stack to the work machine.

What is claimed is:

1. A vertical rise sheet feeder for maintaining the top of a stack of sheets at a feed level, comprising:

a movable platform for supporting a stack of sheets to be fed;

stabilizer means operatively controlled by the weight of the stack for positioning the stack at the feed level and responsive to a rate of change in the weight of the stack for moving the platform to maintain the stack at the feed level;

means for regulating the movement of the platform to maintain the top of the stack in an aligned position at the feed level; and biasing means selectively adjustable between an inoperative position spaced from the movable platform and an operative position acting against the movable platform for urging the stack towards the feed level.

2. A sheet feeder as set forth in claim 1 further comprising:

feed roller means in contact engagement with the top of the stack and operable for feeding a single sheet at a time from the stack.

3. A sheet feeder as set forth in claim 2 further comprising:

sheet separator means resting on each lead end corner of the top sheet of the stack for buckling and separating the top sheet from the stack in response to operation of the feed roller means.

4. A sheet feeder as set forth in claim 1 further comprising:

a pair of side guides positionable towards and away from the side edges of the stack for centering the stack on the platform; and means for positioning the pair of side guides simultaneously in response to moving only one of the pair of side guides.

5. A sheet feeder as set forth in claim 1 in which the means for regulating movement of the platform comprises:

a first and a second pair of linkage means movable in response to movement of the platform;

means interconnecting each of the first and the second pair of linkage means to provide for movement of each of the pair of linkage means in unison; and torsion means interconnecting the first and the second pair of linkage means for controlling operative movement of both of the pairs of linkage means in unison.

6. A sheet feeder as set forth in claim 5 in which each of the first and the second pair of linkage means comprises:

a pair of control links positioned at each lateral side of the platform, each control link of said pair of control links being pivotally supported at one end in the movable platform and supported at the other end for sliding movement in a fixed platform spaced beneath and parallel with the movable platform.

7. A sheet feeder as set forth in claim 1 in which the stabilizer means comprises:

a plurality of compression springs for biasing the platform in a direction urging the stack towards the feed level.

8. A sheet feeder as set forth in claim 1 further comprising:

a fixed platform positioned beneath and parallel with the movable platform;

said stabilizer means being positioned between the movable and the fixed platform and exerting a biasing force to the movable platform in a direction away from the fixed platform.

9. A sheet feeder as set forth in claim 1 further comprising a fixed platform positioned beneath and parallel with the movable platform and means for operatively mounting the sheet feeder between a pair of side plates of a work machine, said mounting means comprising:

a guide pin provided in each side of the movable platform extending outwardly therefrom adjacent a lead end of the movable platform adapted for movement in a horizontal path parallel with the movable platform and in a vertical path towards the feed level between said side plates.

10. A sheet feeder as set forth in claim 9 further comprising:

a pin provided in each side of the fixed platform extending outwardly therefrom adjacent a lead end of the fixed platform adapted to prevent forward movement of the sheet feeder beyond a predetermined point between said side plates.

11. A sheet feeder as set forth in claim 1 in which the biasing means comprises:

a pair of compression springs positioned on a line corresponding to a lateral centerline of the stack on the platform and adjacent the trailing end of the stack.

12. A vertical rise sheet feeder for maintaining a stack of sheets at a feed level for feeding a single sheet at a time from the top of the stack, comprising:

a movable platform for supporting a stack of sheets to be fed;

a fixed platform positioned beneath and parallel with the movable platform;

stabilizer means operatively controlled by the weight of the stack for positioning the stack at the feed level and responsive to a rate of change in the weight of the stack for moving the movable platform to maintain the stack at the feed level;

linkage means including a pair of control links positioned at each lateral side of the movable and the fixed platforms and operatively associated therewith for regulating movement of the movable platform;

torsion means interconnecting a single control link of each pair of control links for controlling operative movement of both said pair of control links in unison; and biasing means selectively adjustable between an inoperative position spaced from the movable platform and an operative position acting against the movable platform for urging the stack towards the feed level.

* * * * *